United States Patent [19]

Wittig et al.

[11] Patent Number: 4,795,028

[45] Date of Patent: Jan. 3, 1989

[54] COMBINATION BEVERAGE PACKAGE

[75] Inventors: Norman P. Wittig; David Groh, both of Corry, Pa.

[73] Assignees: Erie Plastics Corp., Corry, Pa.; Mike Schecter Associates, Inc., Tampa, Fla.

[21] Appl. No.: 125,326

[22] Filed: Nov. 25, 1987

[51] Int. Cl.[4] ..... B65D 77/00

[52] U.S. Cl. ..... 206/217; 220/23.2; 220/23.4; 220/23.83; 220/20; 220/DIG. 3; 229/1.5 H; 215/6

[58] Field of Search ..... 206/217, 219, 221, 509, 206/520, 621, 621.7; 215/6, 108 R; 220/23.2, 23.4, 23.6, 23.83, 23.86, 20, 266, 270, DIG. 3; 229/1.5 H, 123.2, 123.3, 1.5 B

[56] References Cited

U.S. PATENT DOCUMENTS

| | | | |
|---|---|---|---|
| 378,752 | 2/1888 | Ader | 215/6 |
| 598,581 | 2/1898 | Spencer | 229/123.3 |
| 777,305 | 12/1904 | Priestnall . | |
| 1,798,339 | 3/1931 | Soulis . | |
| 2,204,784 | 6/1940 | Abrams | 220/20 |
| 2,328,872 | 9/1943 | Yealdhall et al. . | |
| 2,654,974 | 10/1953 | Rosenthal . | |
| 2,766,796 | 10/1956 | Tupper . | |
| 3,348,716 | 10/1967 | Nakata | 206/509 |
| 3,403,812 | 10/1968 | Weber | 220/266 |
| 3,526,316 | 9/1970 | Kalogris . | |
| 3,684,124 | 8/1972 | Song | 220/270 |
| 3,915,296 | 10/1975 | Spencer | 206/217 |
| 3,920,120 | 11/1975 | Shveda . | |
| 4,027,779 | 6/1977 | Delong | 220/23.83 |
| 4,033,453 | 7/1977 | Giaimo . | |
| 4,054,220 | 10/1977 | Rosenstein | 215/6 |
| 4,215,793 | 8/1980 | Packard | 229/123.2 |
| 4,324,338 | 4/1982 | Beall . | |
| 4,416,370 | 11/1983 | Beall . | |
| 4,660,735 | 4/1987 | Peschardt et al. | 220/270 |

FOREIGN PATENT DOCUMENTS

| | | | |
|---|---|---|---|
| 1031738 | 4/1975 | Canada | 206/217 |
| 778089 | 12/1934 | France | 220/20 |
| 840184 | 1/1939 | France | 220/20 |
| 1271324 | 1/1962 | France . | |

*Primary Examiner*—David T. Fidei

*Attorney, Agent, or Firm*—Parkhurst, Oliff & Berridge

[57] ABSTRACT

A combination beverage package having a primary chamber and a secondary chamber beneath. The primary chamber includes a substantially cylindrical sidewall containment and a bottom closure panel. The secondary chamber below being a detachable substantially cylindrical sidewall containment with a secondary bottom closure panel being spaced apart from the primary closure panel by the secondary substantially cylindrical containment. A complimentary product is placed in the secondary chamber during manufacture and can be removed by the user through detachment of the secondary containment chamber.

14 Claims, 2 Drawing Sheets

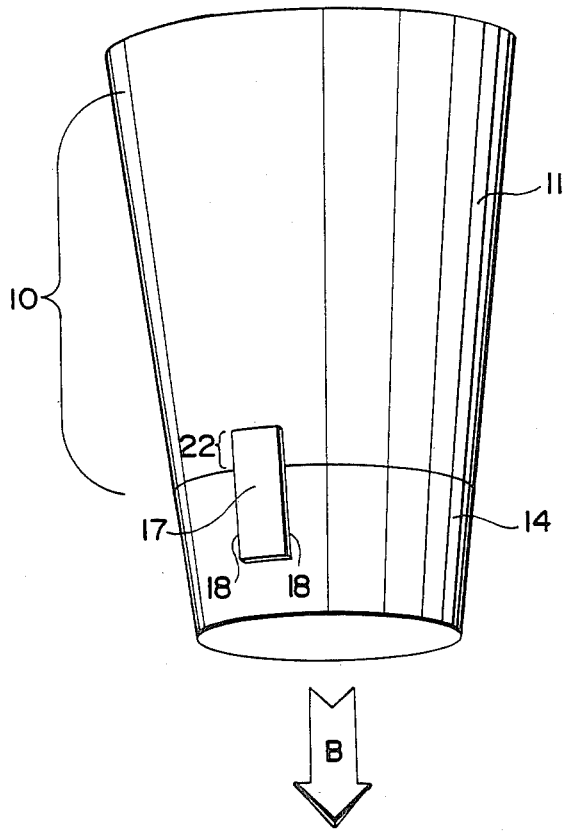
Fig. 1
Fig. 2
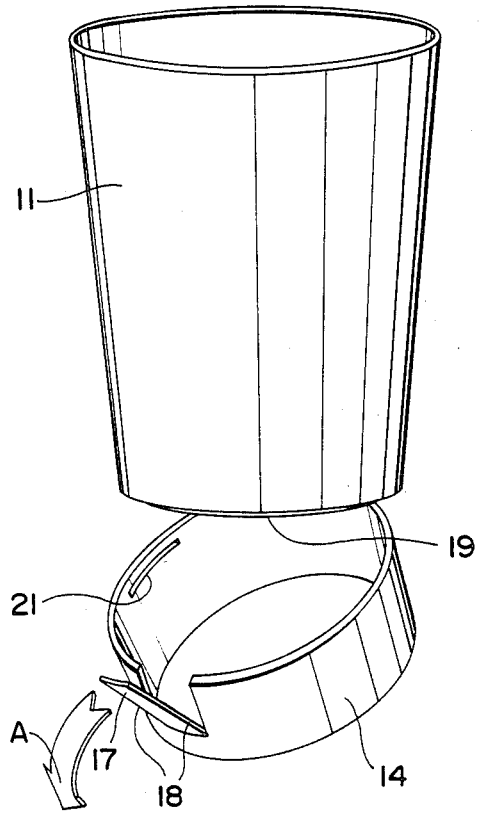

COMBINATION BEVERAGE PACKAGE

BACKGROUND

The present invention generally relates to the containment of two isolated products of a complimentary nature to be offered in a single combination package. The concept of offering a secondary complimentary product along with a primary product in order to enhance sales of the primary product is not historically unknown in the art. For example, U.S. Pat. Nos. 777,305, 2,654,974, and 3,920,120 all show this type of package. However, the prior art requires a secondary means of affixing the complimentary product within the secondary chamber. In addition, the prior art in this area of concern requires a complicated manufacturing process to attach to or seal the secondary chamber to the primary chamber.

SUMMARY

This invention is a package for a primary product in combination with a secondary product complimentary to the primary product but isolated therefrom.

It is an object of the present invention to eliminate the secondary affixing means required by the prior art.

It is also an object of the present invention to simplify the manufacturing process associated with attaching or sealing the secondary chamber to the primary chamber.

A further object of this invention is to provide a combination package which is suitable for the containment of complimentary products in a secure manner through the inability of the package to be separated accidentally, yet allowing the intended user to easily separate the package.

The present invention comprises a two compartment container having a primary container and a secondary container beneath, which is mechanically secured to the primary container. The primary container includes a perimeter side wall and planar bottom closure panel. The secondary container also includes a perimeter side wall and planar bottom closure panel. A means to mechanically secure the secondary container to the primary container is provided by opposing ribs formed on the secondary container and the primary container. A handle including a gripping member and severable portions is provided on the secondary container to allow separation of the secondary container from the primary container. This separation occurs when a user, grasping the gripping member, pulls down on the handle to partially separate the handle from the secondary container to allow access to an internal volume of the secondary container, or, to release the opposing mechanical securing ribs, thus separating the secondary container from the primary container and enabling the user to remove the contents of the secondary container.

BRIEF DESCRIPTION OF THE DRAWINGS

FIG. 1 is a perspective view of one embodiment of the present invention.

FIG. 2 is a perspective view of another embodiment of the present invention.

Figure 3:
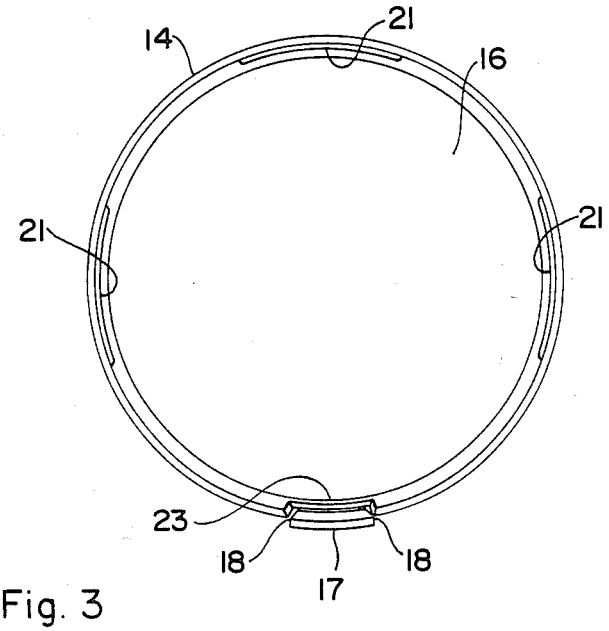
FIG. 3 is an elevational view from the top of the secondary chamber showing the secondary chamber restraining means.

These and other objects and advantages of the present invention will become apparent to those skilled in the art after considering the following detailed specification in conjunction with the accompanying drawings.

DETAILED DESCRIPTION OF THE INVENTION

An embodiment of the two compartment container of the present invention is illustrated in FIGS. 1 to 4. The two compartment container 10 is illustrated as includng a primary container 11 having a perimeter side wall 12 and a bottom planar closure panel 13 engaged with a secondary container 14 having a perimeter side wall 15, a bottom planar closure panel 16, an engagement means including 19–21, 23 and a handle 17. The handle 17 further includes severable portions 18, which enables handle 17 to be partially separated from the secondary container 14, thereby allowing access to the secondary container 14 or, allowing the secondary container to be removed from the primary container 11.

Figure 4:
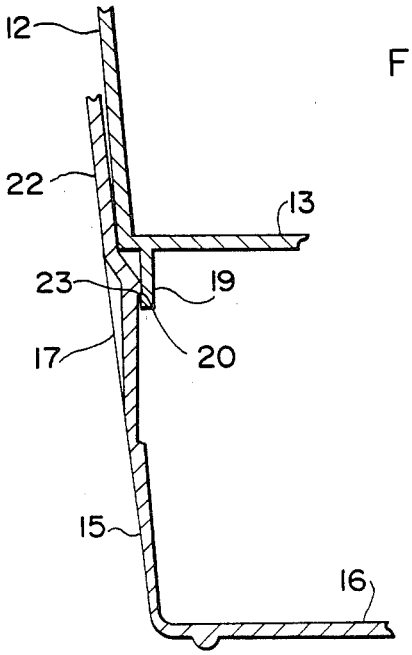
FIG. 4 is an elevational view in cross section of the secondary chamber showing the secondary chamber restraining means in detail.

The two compartment container 10 includes means for securing the primary container 11 to the secondary container 14. As illustrated in FIG. 4, the securing means can comprise a downwardly extending circular member 19 with a rib 20 on the outer face of circular member 19, wherein the circular member 19 is affixed to the bottom planar closure panel member 13 of the primary container 11. The perimeter side wall 15 of the secondary container 14 has locking ribs 21 which engage with rib 20 on circular member 19 when the primary container 11 is assembled with the secondary container 14. Assembly of the containers is performed by a non-adherent process which utilizes a tertiary component or agent to effect a secure mechanical coupling between the primary and secondary containers.

In addition, the secondary container 14 has a handle 17 with locking rib 23. A gripping member, such as the upwardly extending portion of handle 17, is provided so as to allow a user to grasp the gripping member 22 and pull handle 17 in a downward motion (A) to separate the handle 17, along the vertical severable portions 18, from the perimeter side wall 15 of the secondary container 14. This separation will disengage locking rib 23 of handle 17 from locking rib 20 of circular member 19, thereby allowing locking ribs 21 to become disengaged from locking rib 20, and thus providing a complete separation (B) of the primary container 11 from the secondary container 14. This complete separation allows the user to remove the contents in the secondary container.

In an alternate embodiment, the handle 17 can be partially separated from the secondary container 14, such that the vertical severable portions 18 define an opening in the secondary container of sufficient size to provide adequate access to an internal volume defined by the secondary container.

Many changes, modifications, variations and other uses and applications of the present invention may become apparent to those skilled in the art after considering this specification and the accompanying drawings. All such changes, modifications, variations and other uses and applications which do not depart from the spirit and scope of the invention are deemed to be covered by the present invention and the pending claims.

What is claimed is:

1. A two compartment container comprising:

a primary container comprising a perimeter side wall containment, a planar bottom closure member, and a circular member with at least one locking rib, said circular member extending from said planar member in a substantially longitudinally opposite direction from said side wall;

a secondary container comprising a perimeter side wall containment and a planar bottom closure member;

means for securing said secondary container to said primary container at a lower end thereof; and a handle including a gripping member, said handle formed integrally with said secondary container, attached thereto by at least one severable portion and extending upward from an upper edge of the perimeter sidewall containment of the secondary container;

whereby said handle can be partially separated from said secondary container, thus enabling said secondary container to be disengaged from said primary container.

2. A container according to claim 1, wherein said means for securing said secondary container to said primary container comprises at least one outwardly projecting rib portion formed on said circular member and at least one inwardly projecting rib portion formed on said side wall of said secondary member, whereby said at least one outwardly projecting rib portion contacts said at least one inwardly projecting rib portion thereby mechanically engaging said primary container and said secondary container.

3. A container according to claim 2, wherein said handle can be partially separated from said secondary container through said at least one severable portion, thereby disengaging the locking ribs of said primary and said secondary containers.

4. A container according to claim 1, wherein said at least one severable portion is a substantial connecting means between said handle and said secondary container, whereby at least one tear line is formed at said at least one severable portion when said handle is partially separated from said secondary container.

5. A container according to claim 1, wherein said at least one severable portion is of a sufficient size so as to provide adequate access in said secondary container to allow for easy disengagement of said primary container from said secondary container when said handle is partially separated from said secondary container.

6. A container according to claim 1, wherein said primary container and said secondary container are assembled by using a tertiary component or agent to effect a secure coupling between said secondary container and said primary container.

7. A container according to claim 1, wherein said primary container and said secondary container are assembled by a non-adherent process to effect a secure coupling.

8. A container according to claim 1, wherein said gripping member extends above said planar member of said primary container in a substantially parallel direction of said side wall.

9. A two compartment container comprising:

a primary container comprising a perimeter side wall containment, a planar bottom closure member, and a circular member with at least one locking rib, said circular member being radially inwardly spaced from said perimeter side wall containment and extending from said planar member in a substantially longitudinally opposite direction from said side wall, said at least one locking rib extending in a substantially outward direction from said circular member;

a secondary container positioned at a lower end of said primary container, said secondary container comprising a perimeter side wall containment, a planar bottom closure member, and a plurality of locking ribs formed on an inner surface of the perimeter side wall containment of said secondary container, said ribs being radially spaced apart and extending substantially inward from said side wall, whereby said at least one outward extending locking rib mechanically engages said plurality of inward extending locking ribs, thereby providing a secure mechanical coupling between said primary container and said secondary container; and a handle integrally formed with said secondary container, said handle including at least one of said plurality of inward extending locking ribs, such that said handle can be partially separated from said secondary container, thereby disengaging said primary container from said secondary container.

10. A container according to claim 9, wherein said handle is substantially connected to said secondary container by at least one severable portion and said at least one severable portion forms at least one tear line between said handle and said secondary container when said handle is partially separated from said secondary container.

11. A container according to claim 9, wherein said handle further comprises a gripping member extending above said planar member of said primary container in a substantially parallel direction of said side wall.

12. A two compartment container comprising:

a primary container comprising a perimeter side wall containment, a planar bottom closure member, and a circular member with at least one locking rib, said circular member extending from said planar closure member in a substantially longitudinally opposite direction from said side wall, said at least one locking rib extending in a substantially outward direction from said circular member;

a secondary container positioned at a lower end of said primary container, said secondary container comprising a perimeter side-wall containment, a planar bottom closure member, a plurality of locking ribs formed on an inner surface of said perimeter side wall and extending substantially inward therefrom such that said at least one locking rib of said primary container engages the locking ribs of said secondary container, thereby mechanically coupling said primary container and said secondary container; and a longitudinal handle member formed integrally with the perimeter side wall of said secondary container, said handle being substantially parallel to said side wall and extending substantially above the planar member of said primary container;

whereby said secondary container is disengageable from said primary container by partially severing said handle from the perimeter sidewall of said secondary container, thereby disengaging said locking ribs and thus disengaging said containers.

13. A two compartment container comprising:

a primary container comprising a perimeter side wall containment, said containment being open at a top end thereof and closed at a bottom end thereof by a planar bottom closure member, said planar member having a circular member formed thereon, said circular member being substantially perpendicular to said planar member and extending in a direction substantially opposite of said top end, said circular member having at least one locking rib formed thereon, said at least one locking rib extending substantially outward from said circular member;

a secondary container positioned at a lower end of said primary container, said secondary container comprising a perimter sidewall containment, said containment being closed at a bottom end thereof by a planar bottom closure member and closed at a top end thereof by the planar bottom closure member of said primary container, said secondary container having a plurality of radially spaced locking ribs formed on an inner surface of said perimeter side wall, said locking ribs extending in a substantially inward direction from said side wall such that said inward ribs engage said at least one outward locking rib; and a longitudinal handle formed integrally with the perimeter sidewall of said secondary container by at least one severable portion, said handle having at least one locking rib formed thereon which extends in a substantially inward direction from said perimeter sidewall, said handle being positioned substantially parallel to said sidewall and extending substantially above the planar member of said primary container;

whereby said secondary container is disengageable from said primary container by partially severing said handle from the sidewall of said secondary container, thereby disengaging said locking ribs and thus disengaging said containers.

14. A two compartment container comprising:

a primary container comprising a perimeter side wall containment, a planar bottom closure panel, and a circular member with at least one locking rib, said circular member extending from said planar member in a substantially longitudinally opposite direction from said side wall;

a secondary container comprising a perimeter side wall containment and a planar bottom closure panel, said secondary container defining an internal volume;

means for securing said secondary container to said primary container at a lower end thereof; and a handle including a gripping member, said handle formed integrally with said secondary container and attached thereto by at least one severable portion;

whereby said handle can be partially separated from said secondary container, and wherein said at least one severable portion defines an opening in said secondary container which is sufficient to provide adequate access to said internal volume defined by said secondary container.

* * * * *